United States Patent [19]

Silverman et al.

[11] 4,040,366

[45] Aug. 9, 1977

[54] AUTOMATIC HEMMING APPARATUS

[75] Inventors: Seymour Silverman, New York; Paul F. Costa, Flushing; Charles Block, North Bellmore, all of N.Y.

[73] Assignee: Silverman Machines, Inc., New York, N.Y.

[21] Appl. No.: 568,561

[22] Filed: Apr. 16, 1975

[51] Int. Cl.[2] ..... D05B 33/02

[52] U.S. Cl. ..... 112/121.29; 112/127; 112/130; 112/141

[58] Field of Search ..... 112/121.29, 121.15, 112/121.11, 121.12, 130, 252, 127, 141, 142, 147, 121.27

[56] References Cited

U.S. PATENT DOCUMENTS

| | | | |
|---|---|---|---|
| 2,432,545 | 12/1947 | Sigoda | 112/127 |
| 2,917,013 | 12/1959 | Burgert | 112/127 |
| 3,204,590 | 9/1965 | Rockerath et al. | 112/121.29 |
| 3,577,944 | 5/1971 | Willenbacher | 112/127 |
| 3,810,436 | 5/1974 | Marferio | 112/121.15 |
| 3,814,038 | 6/1974 | Dorosz | 112/121.15 |
| 3,884,166 | 5/1975 | Rinehimer et al. | 112/121.29 |

*Primary Examiner*—H. Hampton Hunter
*Attorney, Agent, or Firm*—James & Franklin

[57] ABSTRACT

An apparatus is provided having a continuous band of material passing through the stitching means of a sewing machine. Pieces of material are manually placed individually on the band and hemmed to it at a side which has been folded under the band by a mechanical folder. A sensing means senses the passage of an end of each piece which has had a portion raised from the band and in response activates a cutter which cuts away a strip of the band to which the piece was hemmed. A removal means for moving the strip away from the band and into a stacker is activated after the strip has been cut away from the band. The stacker has a base supporting two spaced, upwardly extending sidewalls defining a passage therebetween. Each of the sidewalls supports a ledge protruding into the passage. A portion of the base is vertically movable and adapted to fit within the space between the ledges. As the strip comes to rest in the passage, the movable portion of the base, upon being actuated by the sensing means, is raised above the ledges and then returned to its original position, leaving the strip resting on the ledges.

40 Claims, 12 Drawing Figures

FIG. 8
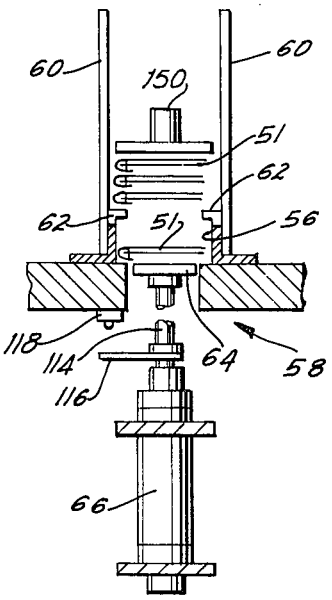
FIG. 9
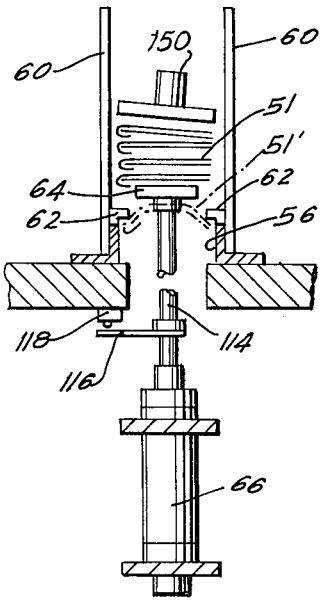
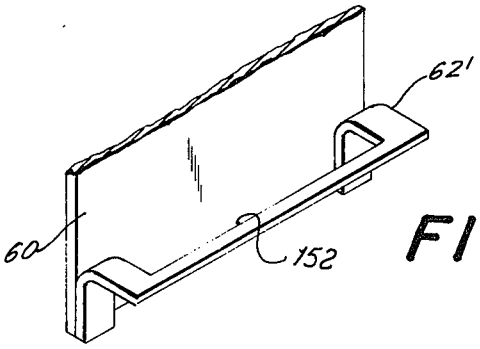
FIG. 11
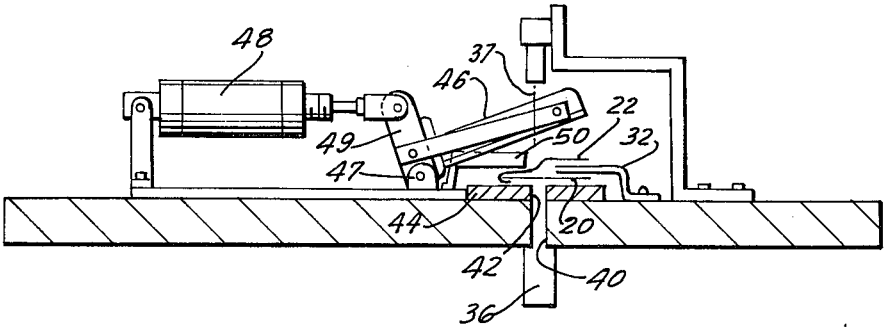
FIG. 7

AUTOMATIC HEMMING APPARATUS

The present invention relates to an apparatus for automatically hemming a piece of fabric to a material and then automatically stacking the resulting products.

In a variety of products involving a sewing operation, particularly in the manufacture of clothing, a piece of one fabric is sewn to a piece of another fabric with the two attached pieces being used to form a part of the finished product. An example of such an operation is involved in the manufacture of shirt cuffs. Each shirt cuff contains a lining between a top layer and a bottom layer of fabric. Conventionally, such a cuff is prepared by first cutting appropriate size strips of lining from a bolt of material, such as canvas. The bolt of lining material has to be carefully laid out in order to utilize it most efficiently. This is a laborious, time-consuming procedure requiring a skilled workman, and still some wastage is unvoidable. Once the lining strips have been prepared, strips of shirt fabric are individually hemmed to each strip of lining. This is also a skilled operation which involves placing one strip of fabric on one strip of lining, folding a side of the fabric under the lining, and then sewing the two together at the folded side. The attached strips are individually stacked manually to await the next step in the manufacturing process. Completion of the cuff then involves further work, but its description will not be included here because the present invention concerns only the above-described portion of the operation. The term "cuff" will be used hereafter to refer to the product of that portion of the operation described in detail up to this point and which is the finished product of the apparatus of the present invention when used in the manufacture of shirts. As seen from the above, the standard method of preparing shirt cuffs involves several steps, each of which is time consuming, requires usage of skilled labor, and is, therefore, relatively expensive.

It is a primary object of the present invention to provide a machine for automatically hemming one piece of material to another relatively quickly and without the need for skilled labor.

Another object of the present invention is to provide a hemming machine that is reliable and relatively inexpensive.

A further object of the present invention is to provide a machine that efficiently and conveniently stacks the finished product of the hemming operation.

A still further object of the present invention is to provide a compact apparatus for hemming and stacking.

In accordance with the above objects, an apparatus is provided to be used in combination with a sewing machine for hemming a piece of material to a continuous band of material. The band passes through a sewing machine. As each piece is individually placed on the moving band, it passes through a mechanical folder which folds one side of the piece under the band. The folded side is then sewn to the band. A strip of the band carrying the piece is then cut away from the band and automatically removed into a stacker. The cutting, moving and stacking operations are actuated by a sensing means. The sensing means is responsive to the vertical separation between the fabric and the lining which is attained with a separator means. The vertical separation enables reliable operation of the sensing means with all types of materials. The stacker is comprised of a base supporting two upwardly extending sidewalls defining a passage therebetween. A ledge, or bracket, attached to each sidewall extends into the passage. A portion of the base is vertically movable and fits between the ledges. The vertically movable portion of the base lifts the strip above the ledges and returns to its original position, leaving the strips supported by the ledges. Thus, the only duties of the operator are to place the pieces on the band and to remove the stacked pile of finished products. Such duties require little skill, eliminating the need for a skilled operator while the automated procedure results in a significant decrease in production time.

To accomplishment of the above and to such other objects as may hereinafter appear, the present invention relates to the construction of a hemming and stacking apparatus, as defined in the appended claims and as described in this specification, taken together with the accompanying drawings, in which:

FIG. 7 is a sectional view taken along lines 7—7 in FIG. 2;

FIG. 8 is a sectional view taken along lines 8—8 in FIG. 2 showing the stacker;

FIG. 9 is the same view as FIG. 8 with the movable plate of the stacker being in its raised position;

FIG. 11 is an isometric view of a modified form of a bracket for the stacker shown in FIGS. 8 and 9.

In order to speed up and simplify the hemming operation, it is essential to eliminate the tedious manual process of laying out and then cutting a bolt of lining material into strips. Also, the hemming operation comprised of the folding over and sewing steps should be done automatically to eliminate the need for skilled operator and to speed up the operation. Finally, the end product of the hemming operation should be automatically stacked to completely automate the operation for faster and more economical manufacture. These features are embodied in the present invention with the actually encountered results being that production is increased considerably by virtue of eliminating the need for manual cutting, sewing and stacking, and the unit cost is reduced by eliminating the need for a skilled operator.

Figure 1:
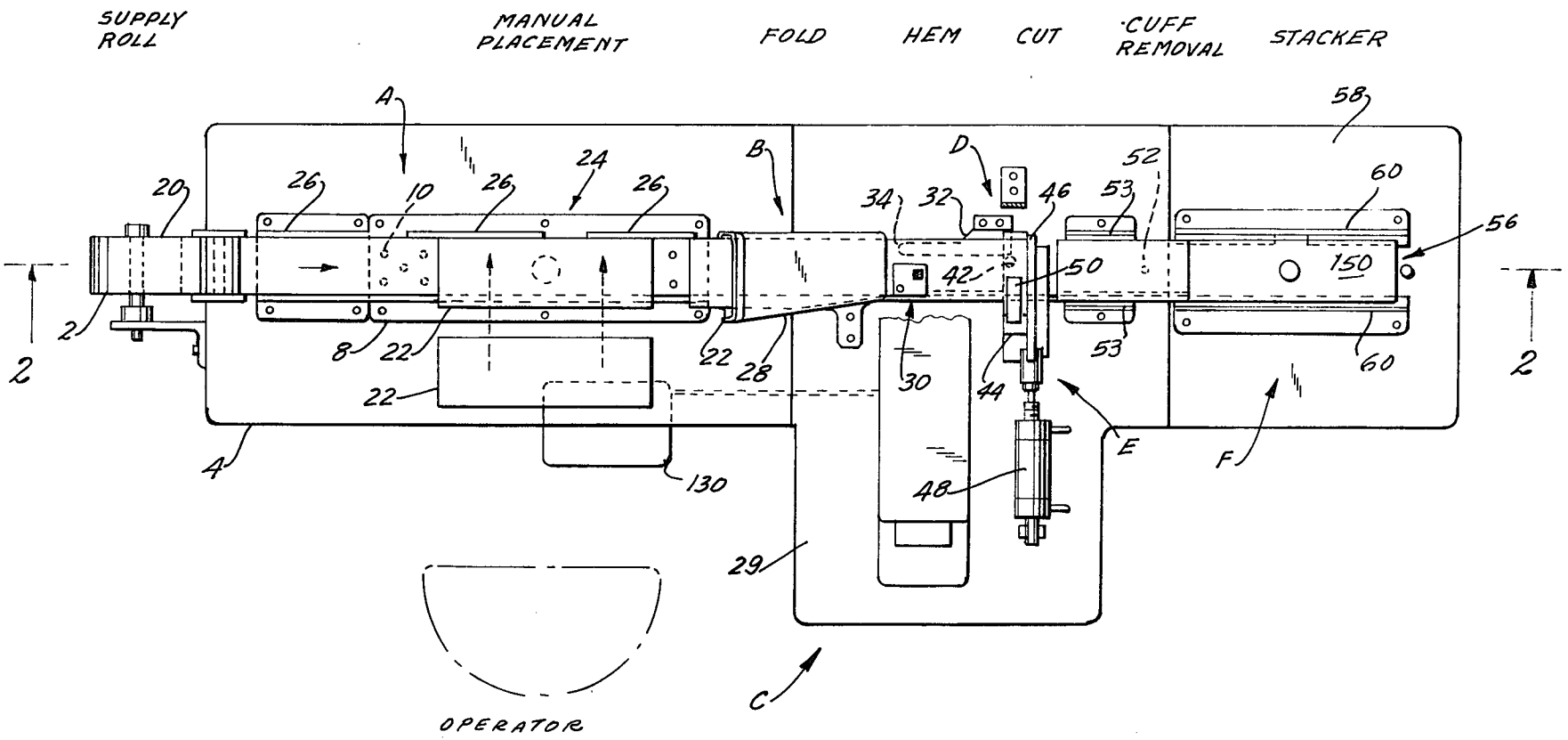
FIG. 1 is a top plan view of the apparatus with the top part of the sewing machine and the photocell cut away.
Figure 2:
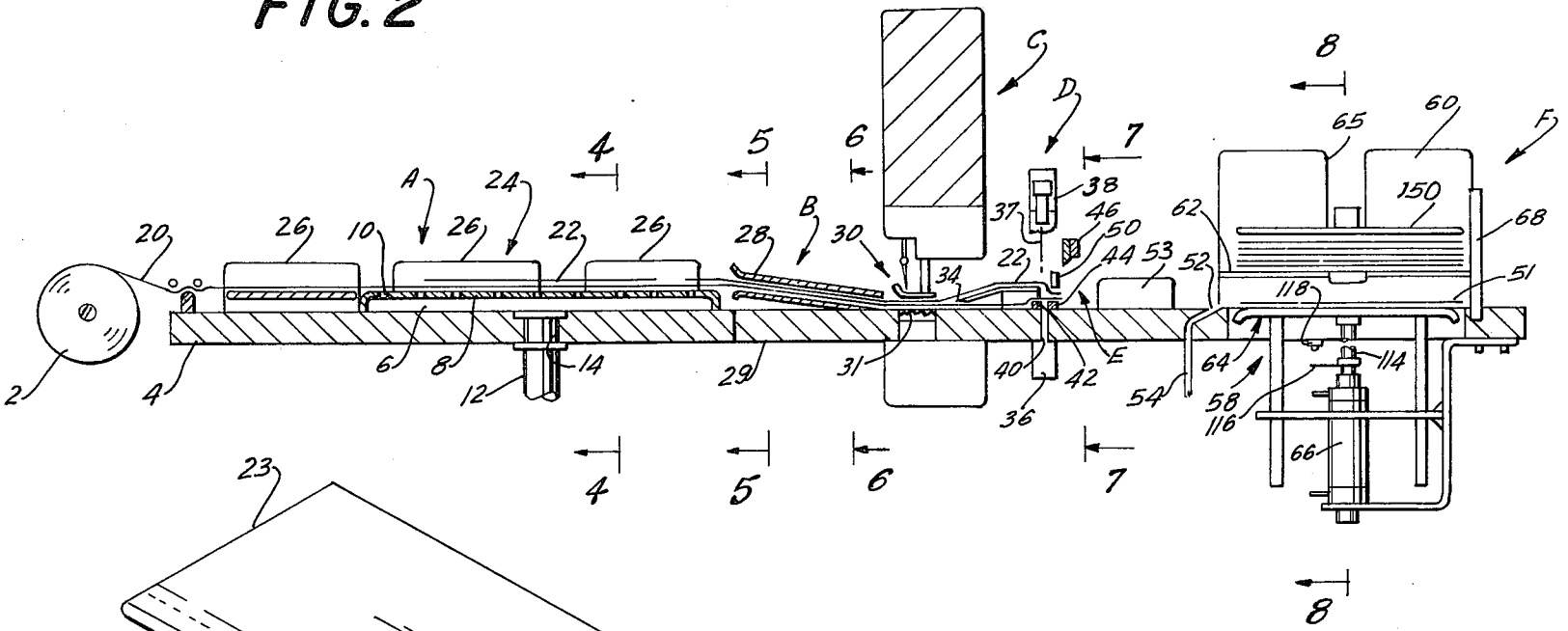
FIG. 2 is a sectional view of the apparatus taken along lines 2—2 in FIG. 1.

Using the manufacture of a shirt cuff to explain an exemplary application of the present invention, a supply roll of lining material is used rather than a bolt. The width of the roll is that of the coventionally used lining strip, and it need only by cut at appropriate intervals to provide the proper cuff length. Thus, the tedious layout procedure involved with bolts of cloth is eliminated. As shown in FIGS. 1 and 2, the band of lining material is unwound from the roll and passes over a support means A, through a folder B to sewing machine C, past a sensing means D and through cutting means E. Previously prepared strips of fabric are manually placed on top of the band at support means A. Sensing means D senses the passage of a trailing edge of each fabric strip after it has been hemmed to the band by folder B and sewing machine C. Cutting means E is actuated by sensing means D to cut the cuff away from the band. Stacking means F then removes the cuff from the cutting means into a stacker where a plurality of cuffs are stacked in a pile for easy removal by the operator. Thus, the only duties of the operator are to place the fabric pieces individually on top of the lining at the support means A and to remove the pile of cuffs from stacker F. Since the lining moves continuously, the cutter cuts automatically, and the stacker stacks automatically, there are no intervening, time-consuming ans skill-requiring manual operations involved in the entire above-described procedure. Consequently, the speed of production is considerably increased, and the unit cost per cuff is considerably decreased.

Turning now to a more specific description of the present invention, FIGS. 1 and 2 show support means A to be comprised of a rotatable roll 2 fixed to and extending from one end of table 4. The top surface of table 4 forms an elongated suction box 6 with a plate 8. Pla'e 8 encloses box 6 on top and on all sides and its attachment to table 4 is substantially airtight. The top of plate 8 has a plurality of holes 10 along its length. A tube 12 is inserted through hole 14 in table 4 and it serves to put box 6 in communication with a vacuum source 16 (see FIG. 10). The suction produced by vacuum source 16 operates to attract anything placed on top of plate 8 downward. Thus, as the band of lining material 20 unwinds from roll 2 and moves across plate 8 towards sewing machine C, it, as well as the strips of fabric 22 placed on it by the operator at position 24, will be kept from being misaligned by accidental bumping of the machine, vibration, or by the slight air disturbance produced when someone passes by the machine and to which the light fabric may be susceptible. Such a misalignment would result to a faulty cuff. One or more elongated guide plates 26 are attached to one edge of box 6 to aid in guiding the movement of band 20 as well as to facilitate the proper placement of strip 22 on top of band 20 at position 24 by the operator.

Figure 5:
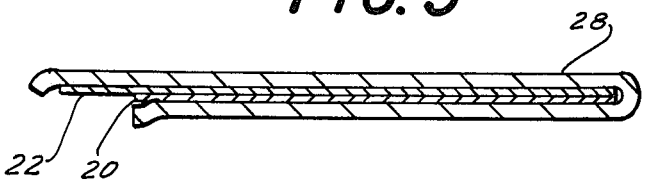
FIG. 5 is a sectional view taken along lines 5—5 in FIG. 2 showing the entrance to the folder.
Figure 6:
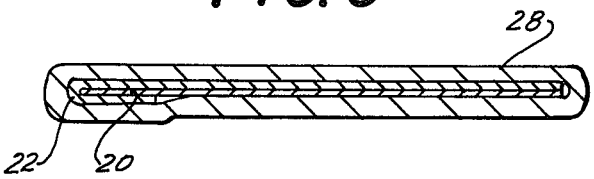
FIG. 6 is a sectional view taken along lines 6—6 in FIG. 2 showing the exit of the folder.

As best seen in FIGS. 1 and 5, when the edges of band 20 and strip 22 are aligned by guide plate 26, the other edge of strip 22 overhangs band 20. As strip 22 continues its downstream movement with band 20, it enters folder B which is comprised of a conventional mechanical folder 28 attached to table 29 of sewing machine C. Folder 28 folds the overhanging edge of strip 22 under band 20 (as best seen in FIG. 6). Folder 28 then guides this folded side to the stitching means 30 of the sewing machine C where the hem is sewn. It should be noted that sewing machine C also serves to provide the motive power for band 20 as the conventional feed-dogs 31 move the band 20 through stitching means 30.

Sensing means D is attached to sewing machine C downstream of stitching means 30. Its function is to sense the passage of a strip 22 to actuate the automtic cutting and stacking operations to be described in detail below. Sensing means D is comprised of a light source 36 and a photocell 38. Source 36 is secured below table 29 of sewing machine C and its beam 37 shines upward through hole 40 in table 29 and hole 42 in blade 44 of the cutting means E. Photocell 38 is aligned with light source 36, hole 40, and hole 42 to sense the light beam when no object intervenes. Of course, the positions of source 36 and photocell 38 can be reversed without affecting proper operation of the sensing means D. Sensing means D is a "make" type of device. This means that it generates an output control signal only when photocell 38 senses the light beam after its having been interrupted for a period of time. Thus, no output control signal is transmitted when the light beam is continuously sensed, continuously broken or upon interruption of the beam. Since the light beam shines through the white band 20, band 20 has no effect on sensing means D. When the leading edge of a strip 22 intervenes between source 36 and cell 38, the light beam is interrupted, but still no signal is generated. However, as the trailing edge of strip 22 passes, the path of the light beam 37 is completed to cell 38 and a control signal is generated.

Clearly, then, the strip 22 must be made of a material which is opaque to light so that the light beam 37 is interrupted. Otherwise, the cutting and stacking means will not be actuated. A problem arises, therefore, when the fabric of strip 22 is substantially transparent to the beam and thus fails to interrupt the beam. We have found that lifting strip 22 at its unsewn side from band 20 is effective to activate sensing means D. The reason for this effect is not entirely clear, but it serves to reliably activate sensing means D with all types and colors of material.

A separator plate 32 is provided to lift strip 22 from band 20 to provide the reliable operation of sensing means D discussed above. Separator plate 32 is attached to sewing machine table 29 between stitching means 30 and sensing means D. As best seen in FIG. 2, separator plate 32 is angled upward away from band 20 with its upstream edge 34 resting on band 20. Thus, as the leading edge of the unsewn portion of strip 22 comes in contact with edge 34, it is directed upward by the angled portion of separator plate 34, as best seen in FIG. 7, while band 20 continues to move under edge 34.

Cutting means E is comprised of two blades 44 and 46 hinged together at one end to provide the conventional scissor-type action. Blades 44 and 46 are placed across band 20 and are long enough to completely cut band 20 and perform the final step in producing cuff 51. Blade 44 is fixed to the table of the sewing machine with blade 46 being rotatable about a hinge 47 attached to table 29. A pneumatic cylinder 48 is attached to blade 46 by a bar 49 to lower blade 46 when cylinder 48 is actuated.

Blade 44 has a hole 42 through it which completes the path from light source 36 to photocell 38. It is preferable to have hole 42 in this spot so the cutting means E can be actuated immediately upon the trailing edge 23 of strip 22 being sensed. If sensing means D were further removed from cutting means E, a time delay would be required to cut the band at the proper place. This increases production time. The lease amount of time is required when the sensing means is adjacent the cutter, as in the preferred embodiment.

Attached to sewing machine C above blade 44 is a curl-in guide, or lip 50 which contacts the top of strip 22 and keeps the hemmed side flat against blade 44, as best seen in FIG. 7. Without guide 50, the leading edges of band 20 and strip 22 might curl upward and be diverted from the normal path when blade 46 is in the cutting position, since band 20 is continuously moving. Such a situation might result in faculty operation of the apparatus. Consequently, it is the task of guide 50 to keep band 20 and strip 22 from straying off course.

Guides 53 are attached to the sewing machine C between cutter E and the nozzle 54, The guides 53 are positioned on both sides of cuff 51 and prevent its misalignment due to the cutting action or to any extraneous cause in order to keep it in proper alignment with stacker F.

After the cuff has been cut, it is necessary to remove it from the path of the cuffs that are to follow, and stack it along with a number of others into a pile. This task is performed by stacking means F which is comprised of a nozzle 52 directed upward and downstream. Nozzle 52 is operably connected to an air compressor (not shown) by means of a tube 54. As compressed gas is released through nozzle 52, the cuff is forced downstream away from its resting position. The location of nozzle 52 is such as to provide a quick, smooth movement of the particular material used. Such location varies depending on the material and must be empirically determined.

The completed cuffs are stacked in a passage 56 in stacking means F. As best seen in FIGS. 8 and 9, passage 56 is bounded on the bottom by a base 58 and on its sides by upwardly extending walls 60 attached to base 58. Attached to each of walls 60 and extending into passage 56 are elongated brackets 62. Brackets 62 are narrow in relation to passage 56. A portion of base 58 is a movable plate 64 which is narrow enough to fit between brackets 62. Movable plate 64 is attached to a pneumatic cylinder 66 which, when actuated, moves plate 64 upward between and above brackets 62. Thus, as the cuff is forced downstream by air release through nozzle 52, it enters passage 56 and comes to rest as it abuts against pin 68 at the end of passge 56. FIGS. 2 and 8 show a cuff 51 in this position waiting to be stacked. At the appropriate instant, pneumatic means 66 is actuated to move plate 64 upward to carry the cuff above brackets 62. The cuff 51 being flexible, it yields, as shown by 51' in FIG. 9, as movable plate 64 passes between brackets 62. As penumatic means 66 is deactivated, plate 64 will fall back to its original position while the cuff will come to rest on brackets 62 which function as supporting ledges for cuff 51. Each succeeding cuff will be similarly stacked below its preceding cuff. Consequently, the first cuff stacked is also the uppermost cuff in the stack. This "first in, first out" arrangement is advantageous in efficiently continuing with subsequent operations and permits the stacking of a relatively large number of cuffs. The weight 150 is used on top of the stack to prevent undesirable folding or curling of the cuffs as well as to keep the stack as tightly packed as possible to maximize the number of cuffs that can be accommodated by the height of sidewalls 60. A vertical aperture 65 in sidewalls 60 (see FIG. 2) facilitates the removal of the pile by the operator. Aperture 65 extends below brackets 62 and the operator need only insert his fingers into passage 56 at the bottom of aperture 65 and then lift out the pile.

Since the hemmed edge of the cuff is thicker than the outer edge, the top portion of the stack will be tilted (as shown in FIG. 9) if a large number of cuffs is involved. Thus, instead of being horizontal, the top cuffs will tilt towards the vertical, possibly causing the upper cuffs to slide down or otherwise making removal of the pile more difficult. To provide a more even and more easily removable stack, one of brackets 62 can be modified as shown in FIG. 11. Bracket 62' is elongated and its sides define an aperture 152 having a length at least as long as that of cuff 51 and a width at least as wide as the hemmed edge of the cuff. As the first cuff is positioned on brackets 62 and 62', the thin portion rests on bracket 62' while the thick portion falls into aperture 152. The succeeding cuff will similarly have its thick portion bent downward toward aperture 152. Eventually, of course, the stack will begin to tilt, but this point will be reached only after a signifcantly larger number of cuffs has been stacked than with the use of two solid brackets 62.

Figure 10:
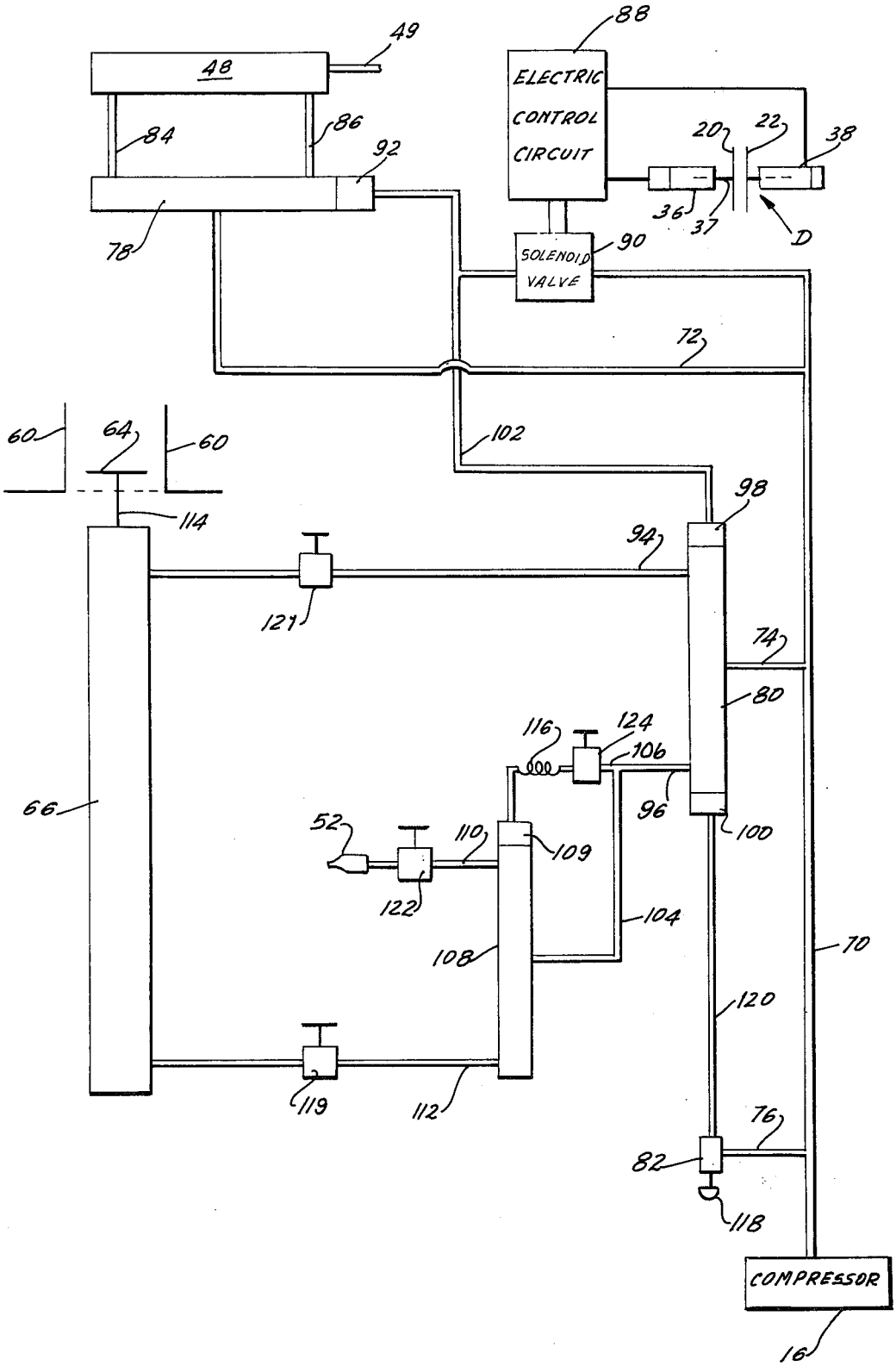
FIG. 10 is the partially electric, partially pneumatic control diagram for the apparatus.

The schematic diagram illustrating how the various portions of this apparatus are actuated is shown in FIG. 10. Compressor 16 feeds air under pressure into main line 70 which branches into lines 72, 74 and 76 feeding into air pilot valves 78, 80 and 82, respectively. Valve 78 controls cutter cylinder 46; valve 80 controls the jet of air through nozzle 52 as well as the reciprocal movement of plate 65; and valve 82 controls the initiation of the downward movement of plate 64. Taking each in turn, valve 78 has two output lines 84 and 86 connected to cylinder 48. Output 84 is normally closed while output 86 is normally open. This means that air pressure from compressor 16 is normally transmitted through lines 70 and 72, valve 78 and line 86 to cylinder 48. This pressure maintains piston rod 49 retracted to keep blade 46 up. When the trailing edge of strip 22 is sensed by sensing means D, electric circuit 88 produces a signal which momentarily opens solenoid valve 90. This allows the transmission of pressure to actuator 92. Actuator 92 causes pilot valve 78 to reverse the states of outputs 84 and 86, much like an electonic flip-flop circuit. Thus, pressure through line 86 is interrupted and the pressure transmitted through line 84 will force the piston rod 49 to extend outward and lower blade 46 to cut band 29. Since valve 90 is open only for a short time, pressure to actuator 92 is quickly removed. It resets itself by returning to its original position by spring-action, and valve 78 resuems its normal state. Thus, pressure through line 86 causes piston rod 49 to retract and thereby raise blade 46.

Air pilot valve 80 has two output lines 94 and 96 and two actuators 98 and 100. Output 94 is normally open, and output 96 is normally closed. Thus, pressure from compressor 16 is normally transmitted to stacker cylinder 66 through lines 70 and 74, valve 80 and line 94 to keep plate 64 in its down position. When solenoid valve 90 opens, pressure is transmitted through line 102 to actuator 98. Actuator 98 causes pilot valve 80 to reverse the states of outputs 94 and 96. In this condition, flow of pressure to the top of cylinder 66 ceases, and pressure is transmitted instead through output line 96. Actuator 98 remains in this position since, in contrast to actuator 92, it is not reset by spring action. Line 96 branches into lines 104 and 106. Line 104 feeds into an air pilot valve 108, identical to valve 78, while line 106 feeds into an actuator 109. Actuator 109 has two output lines 110 and 112 and 110 being normally open, and 112 being normally closed. Thus, when pressure is transmitted through output line 96, a jet of air is immeidately blown through nozzle 52, with plate 64 remaining in its down position. Pressure is transmitted to actuator 109 only after a given time delay (discussed below). Actuator 109 then causes valve 108 to reverse the respective states of outputs 110 and 112. Thus, the air jet ceases, and pressure is transmitted to the bottom of cylinder 66 from compressor 16 through lines 70 and 74, valve 80, line 96, line 104, valve 108 and line 112. This causes plate 64 to be lifted by piston rod 114 to provide the stacking operation. A plate 116 is attached to rod 114, and when plate 64 has moved a preset amount, plate 116 depresses a button 118 attached to the underside of base 58 (see FIGS. 8 and 9). Button 118 actuates valve 82 to transmit pressure through normally closed line 120 to actuator 100. Actuator 100 causes valve 80 to reverse the respective states of lines 94 and 96 and also resets actuator 98. Actuator 100 is identical to actuator 98 in that it is not reset by spring action, and remains in a given position unless moved by actuator 98 or valve 82. Thus, in this condition, pressure is no longer transmitted through lines 96 and 106 to actuator 109, and it resets by spring action to cause valve 108 to close output 112 and open output 110. Also, since output 94 is opened, pressure is transmitted to the top of cylinder 66, as described above, in order to lower the plate 64 to its rest position. The stacker is now ready for its next cycle.

The time delay for delaying transmission of pressure from line 96 to actuator 109 through line 106 can be provided in a number of ways. Our preferred embodiment utilizes a coil of tubing 116. The longer the tubing, the greater the time required for the pressure to be transmitted through it. Thus, this provides a simple, inexpensive time-delay which can be easily varied by simple changing the length of tubing in coil 116.

Flow control valves 119, 121, 122 and 124 are inserted in lines 112, 94, 110 and 106, respectively. These valves provide a fine adjustment for air flow in these lines to control the amount of air transmitted in a given time. Thus, for example, valves 119 and 121 control the speed with which plate 64 rises and falls, respectively. This speed can be increased by opening the valves and vice versa.

Figure 3:
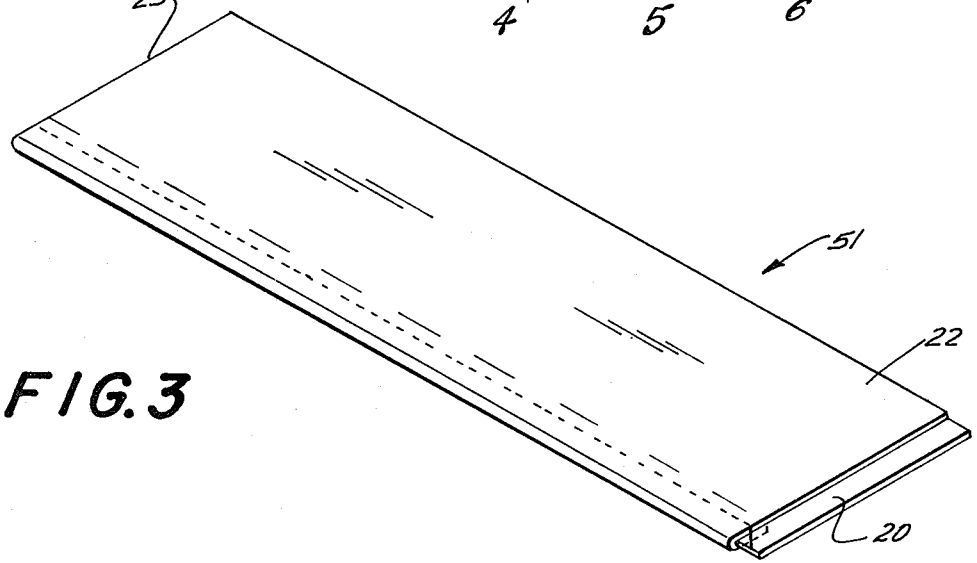
FIG. 3 is a perspective view of a shirt cuff as the finished product of the apparatus.
Figure 4:
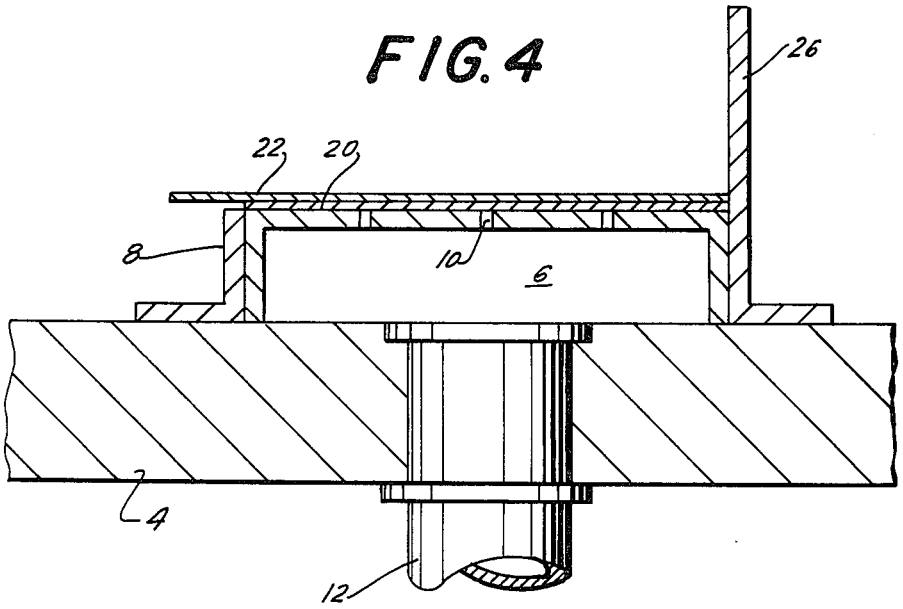
FIG. 4 is a sectional view taken along lines 4—4 in FIG. 2 showing the suction means.

In operation, the machine operator has only relatively simple duties which can be quickly mastered. Specifically, a supply roll 2 of lining material 20 is positioned in place. Band 20 is then placed flatly on plate 6 in abutment with guide plate 26, inserted through folder 28 into stitching means 30, placed under separation plate 32, and then positioned on top of blade 44. With the sewing machine running, the feed dogs continuously move band 20 through the apparatus, but cutting means E will not be actuated, because there is nothing to interrupt beam 37 since it passes through band 20. Once the apparatus is set up, the machine operator places the fabric strip 22 on top of band 20 at position 24 also in abutment or very close to guide plate 26. As the band 20 moves downstream, the leading edge of the next strip 22 is placed approximately one-quarter inch behing the trailing edge of the previous one. (This causes strip 20 to be slightly longer than strip 22 in the cuff 51 shown in FIG. 3.) The operator encounters no difficulty in so placing the strips 22 since the band speed is such as to provide the operator ample opportunity to do so. Should anything go awry, a pedal 130 is provided to enable the operator to stop the sewing machine. Once the cuff has been completed as discussed above, the operator merely stops the sewing machine, removes the stacked cuffs, places them in a box or other appropriate location convenient for subsequent operations.

Experience with the apparatus of the present invention has shown that one unskilled operator utilizing this invention can produce as may cuffs as three skilled operators working on three sewing machines while the skilled operator required to lay-out the bolt of lining cloth is completely eliminated. Beside the obvious significant savings in labor costs, two sewing machines are freed for other uses in a business already owning them, or such machines need not be bought at all by a new business. Additionally, the apparatus of the present invention requires less room than three sewing machines, thereby freeing floor space for other uses or reducing the amount of floor space required in such a business to reduce rental costs. Furthermore, with the apparatus being relatively uncomplicated, breakdown of the equipment is rare. Also, the various components of the apparatus are easily adapted to a conventional sewing machine.

Figure 2A:
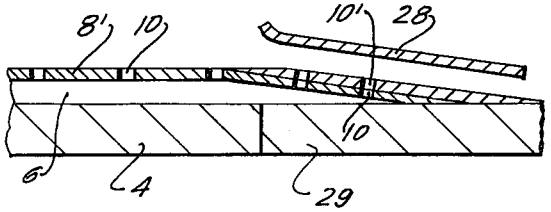
FIG. 2A is a fragmentary view of a part of FIG. 2 illstrating a modified embodiment thereof.

Certain types of material, such as knitted fabrics have a tendency to curl. A strip 22 made of such a material will be maintained flat against band 20 while it is above box 6 due to the suction of vacuum source 16. However, when the strip 22 enters folder 28, it is no longer subject to a suction force in the above described embodiment. Furthermore, the friction it encounters when coming in contact with folder 28 has a tendency to retard its downstream movement. As a result of these two factors, curling of strip 22 may occur inside folder 28. This can result in blockage of the folder or, should the curled strip pass through folder 28, in an improperly formed cuff. To prevent such an occurrence, folder 28 is provided with a suction means by joining it with box 6. As shown in FIG. 2A, top plate 8' of box 6 is actually an extended version of plate 8 with the folder 28 being attached to the extension. Plate 8' has holes 10 along its length, and folder 28 has holes 10' in its bottom portion aligned with holes 10. Thus, a suction force is imparted to strip 22 as it passes through the folder. This configuration is merely exemplary and various other arrangements can be used effectively to provide suction within folder 28.

While but a single embodiment of the present invention has been specifically disclosed, it will be apparent that many variations may be made therein, all within the scope of the instant invention as defined in the following claims.

What is claimed is:

1. In combination with a sewing machine having a stitching means for sewing one side of a plurality of pieces of material, each resting on a continuous band, to one side of said band as it is being moved from a supply through the stitching means, and then cutting said band into strips:

a. a support adapted to be positioned between said supply and said stitching means;

b. an elongated member adapted to support said band, said member being attached to said support and extending for at least a portion of the distance between said supply and said stitching means;

c. means for retaining said pieces of material in position on said band;

d. folder means for folding said one side of said pieces under said one side of said band, said folder means located upstream of and adjacent to the said stitching means;

e. separation means located downstream of said stitching means for vertically separating each of said pieces from said band at an unstitched portion of the pieces, respectively;

f. a cutting means located downstream of said separation means for cutting said band across its transverse axis into said strips when actuated; and g. sensing means located between said cutting means and said separation means for sensing the passage of an end of each of said pieces which is vertically separated from said band and actuating said cutter in response thereto.

2. The apparatus of claim 1, wherein said cutting means is comprised of one relatively fixed blade with its corresponding blade being hingeably attached to said one blade.

3. In the apparatus of claim 2, means for causing said corresponding blade to return to its original position after each cutting operation, and further comprising a retaining means located between said sensing means and said corresponding blade for contacting the top of said band when said blades are fully engaged during the cutting operation and for retaining the leading edge of said band substantially flat as it abuts against said corresponding blade.

4. The apparatus of claim 2, wherein said one blade is closer to said stitching means than said corresponding blade and has a vertical aperture, and wherein said sensing means is comprised of a light source secured on one side of said one blade in alignment with said vertical aperture and a light sensing device secured on the other side of said blade in alignment with said vertical aperture.

5. The apparatus of claim 1, further comprising a removal means located downstream of said cutting means for moving said strips away from said band when actuated, said sensing means being operably connected to actuate said removal means with actuation of said cutter.

6. The apparatus of claim 5, wherein one said blade is closer to said stitching means than said corresponding blade and has a vertical aperture, and wherein said sensing means is comprised of a light source secured on one side of said one blade in alignment with said vertical aperture.

7. The apparatus of claim 6, wherein said removal means is comprised of a nozzle directed away from said band and operably communicating with a source of fluid through an actuating means for controllably releasing fluid through said nozzle, the state of said actuating means being controlled by said sensing means.

8. The apparatus of claim 7, wherein said nozzle is directed downstream.

9. The apparatus of claim 5, wherein said removal means is comprised of a nozzle directed away from said band operably communicating with a source of fluid through an actuating means for controllably releasing fluid through said nozzle, the state of said actuating means being controlled by said sensing means.

10. The apparatus of claim 9, wherein said nozzle is directed downstream.

11. The apparatus of claim 1, wherein said sensing means is responsive to the trailing edge of each of said pieces.

12. The apparatus of claim 1, further comprising a guide means attached to a side of said support and extending for a substantial portion of its length, said guide means being adapted to engage an edge of said band.

13. An apparatus to be used in combination with a sewing machine having a stitching means for sewing one side of a plurality of pieces of material, each resting on a continuous band, to one side of said band as it is being moved from a supply through the stitching means, then cutting said band into strips, and finally stacking said strips into a pile, comprising:

a. a support adapted to be positioned between said supply and said stitching means;

b. an elongated member having apertures at various points along its length and adapted to support said band, said member being attached to said support and extending for at least a portion of the distance between said supply and said stitching means;

c. vacuum means operably communicating with said apertures for retaining said pieces in position on said band;

d. folding means for folding said one side of said pieces under said one side of said band, said folder means being located upstream of and adjacent to said stitching means;

e. a cutting means located downstream of said stitching means for cutting said band into said strips when actuated;

f. pneumatic means located downstream of said cutting means for releasing fluid against said strips when actuated to move said strips away from said band;

g. means located between said cutting means and said stitching means for sensing the passage of each of said pieces of sequentially actuating said cutter and said pneumatic means in response thereto;

h. a pair of vertical sidewalls defining a passage therebetween having a width of aproximately that of said strip, each of said sidewalls having an attached protrusion extending into said passage and defining a space therebetween, said protrusions having a length approximately that of said cut portions;

i. a substantially horizontal base to which said sidewalls are attached having a vertically movable portion vertically aligned with said space, said movable portion having a width approximately that of but smaller than said space and a length substantially that of said strip, said pneumatic means moving said strip into said passage when actuated;

j. power mans operably connected to said vertically movable protrusion to move it, when actuated, between and above said protrusions and then to return it to its original position; and k. means operably connected to said sensing means to actuate said power means when each of said strips has halted within said passage.

14. The apparatus of claim 13, wherein said means to actuate said power means is comprised of a time delay means operably connected between said sensing means and said actuation means to delay actuation of said power means after the sensing of said piece end for a time sufficient to enable each of said cut portions to halt within said passage.

15. The apparatus of claim 13, wherein said passage is substantially aligned with said band.

16. The apparatus of claim 15, wherein said pneumatic means is comprised of a nozzle directed downstream of said band operably communicating with a source of fluid through an actuating means for controllably releasing fluid through said nozzle against said strips, the state of said actuating means being controlled by said sensing means.

17. The apparatus of claim 15, further comprising a pair of vertically extending guides fixed between said pneumatic means and said passage in alignment with said band and on opposite sides of said cut portions.

18. The apparatus of claim 13, wherein one of said sidewall protrusions is comprised of sides defining an elongated aperture, said aperture being adapted to accommodate therein said sewn together sides of said strip and said piece.

19. The apparatus of claim 13, further comprising another guide means fixed between said pneumatic means and said passage to guide said cut portions in said passage.

20. The apparatus of claim 13, wherein said pneumatic means is comprised of a nozzle directed downstream of said band operably communicating with a source of fluid through an acutating means for controllably releasing fluid through said nozzle against said strips, the state of said actuating means being controlled by said sensing means.

21. The apparatus of claim 13, further comprising a flat weight resting on said strips as they, in turn, rest on said protrusions, said weight having approximately the dimensions of said strips.

22. The apparatus of claim 13, further comprising a guide means attached to a side of said support and extending for a substantial portion of its length, said guide means being adapted to engage an edge of said band.

23. The apparatus of claim 13, further comprising a separation means adapted to be attached to said sewing machine downstream of said stitching means for vertically separating each of said pieces from said band at an unstitched portion of said piece, said sensing means being responsive to said vertical separation.

24. In combination with a sewing machine having a stitching means for sewing one side of a plurality of pieces of material, each resting on a continuous band, to one side of said band as it is being moved from a supply through the stitching means, and then cutting said band into strips:

a. a support adapted to be positioned between said supply and said stitching means;
b. an elongated member adapted to support said band, said member being attached to said support and extending for at least a portion of the distance between said supply and said stitching means;
c. means for retaining said pieces of material in position on said band;
d. folder means for folding said one side of said pieces under said one side of said band, said folder means being located upstream of and adjacent to said stitching means;
e. a cutting means located downstream of said folder means for cutting said band into said strips when actuated, said cutting means being comprised of one relatively fixed blade with its corresponding blade being hingeably attached to said one blade, said one blade being closer to said stitching means than said corresponding blade and having a vertical aperture therethrough; and
f. sensing means for sensing the passage of an end of each of said pieces and actuating said cutting means in response thereto, said sensing means being comprised of a light source secured on one side of said one blade in alignment with said vertical aperture and a light sensing device secured on the other side of said one blade in alignment with said vertical aperture.

25. In the apparatus of claim 24, means for causing said corresponding blade to return to its original position after each cutting operation, and further comprising a retaining means located between said sensing means and said corresponding blade for contacting the top of said band when said blades are fully engaged during the cutting operation and for retaining the leading edge of said band substantially flat as it abuts against said corresponding blade.

26. The apparatus of claim 24, further comprising a removal means located downstream of said cutting means for moving said strips away from said band when actuated, said sensing means being operably connected to actuate said removal means with actuation of said cutting means.

27. The apparatus of claim 26, wherein said removal means is comprised of a nozzle directed away from said band and operably communicating with a source of fluid through an actuating means for controllably releasing fluid through said nozzle, the state of said actuating means being controlled by said sensing means.

28. The apparatus of claim 27, wherein said nozzle is directed downstream.

29. The apparatus of claim 25, further comprising a removal means located downstream of said cutting means for moving said strips away from said band when actuated, said sensing means being operably connected to actuate said removal means with actuation of said cutting means.

30. The apparatus of claim 29, wherein said removal means is comprised of a nozzle directed away from said band and operably communicating with a source of fluid through an actuating means for controllably releasing fluid through said nozzle, the state of said actuating means being controlled by said sensing means.

31. The apparatus of claim 30, wherein said nozzle is directed downstream.

32. The apparatus of claim 24, wherein said sensing means is responsive to the trailing edge of each of said pieces.

33. The apparatus of claim 24, further comprising a guide means attached to a side of said support and extending for a substantial portion of its length, said guide means being adapted to engaage an edge of said band.

34. The apparatus of claim 24, further comprising separation means located downstream of said stitching means and upstream of said sensing means for vertically separating each of said pieces from said band at an unstitched portion of the pieces, respectively.

35. The apparatus of claim 25, wherein said separation means is upstream of said cutting means.

36. The apparatus of claim 24, wherein said elongated member has apertures at various points along its length and said folder means has apertures at various points along its length adapted to be positioned below said band as said band passes through said folder means; and wherein said means for retaining said pieces of material in position on said band comprises vacuum means operably communicating with both said elongated member apertures and said folder means apertures.

37. The apparatus of claim 1 wherein said elongated member has apertures at various points along its length and said folder means has apertures at various points along its length adapted to be positioned below said band as said band passes through said folder means; and wherein said means for retaining said pieces of material in position on said band comprises vacuum means operably communicating with both said elongated member apertures and said folder means apertures.

38. The apparatus of claim 13 wherein said elongated member has apertures at various points along its length and said folder means has apertures at various points along its length adapted to be positioned below said band as said band passes through said folder means; and wherein said means for retaining said pieces of material in position on said band comprises vacuum means operably communicating with both said elongated member apertures and said folder means apertures.

39. The apparatus of claim 1 wherein said separation means is configured and disposed so as to be ineffective to preclude cutting of said pieces of material by said cutting means when said cutting means is cutting said band.

40. The apparatus of claim 1 wherein said cutting means includes a generally vertically movable blade adapted to traverse the horizontal plane of said separation means during cutting of said band.

* * * * *